United States Patent [19]

Hurst

[11] 4,305,214

[45] Dec. 15, 1981

[54] IN-LINE CENTRIFUGAL PUMP

[76] Inventor: George P. Hurst, 235 Hill St., Jackson, Calif. 95642

[21] Appl. No.: 65,253

[22] Filed: Aug. 10, 1979

[51] Int. Cl.[3] ..... E02F 3/88

[52] U.S. Cl. ..... 37/67; 415/52; 415/203; 415/196; 417/205

[58] Field of Search ..... 37/67, 58, 64, 65, 66; 417/205; 415/196, 66, 203, 52, 53 R

[56] References Cited

U.S. PATENT DOCUMENTS

| | | | |
|---|---|---|---|
| 390,332 | 10/1888 | Andrews | 415/203 X |
| 418,496 | 12/1889 | Brown | 37/58 |
| 664,010 | 12/1900 | Walsh | 37/67 |
| 1,374,533 | 4/1921 | Stenberg . | |
| 2,346,180 | 4/1944 | Neuman | 37/67 |
| 2,352,394 | 6/1944 | Little | 37/67 |
| 3,847,504 | 11/1974 | Martin | 415/203 X |
| 4,083,135 | 4/1978 | van den Brink et al. | 37/58 |

FOREIGN PATENT DOCUMENTS

| | | | |
|---|---|---|---|
| 348630 | 5/1921 | Fed. Rep. of Germany . | |
| 523165 | 4/1931 | Fed. Rep. of Germany . | |
| 52-38609 | 3/1977 | Japan | 417/205 |
| 601420 | 4/1978 | U.S.S.R. | 37/58 |

*Primary Examiner*—Clifford D. Crowder
*Attorney, Agent, or Firm*—Townsend and Townsend

[57] ABSTRACT

A ladder pump for use with a hydraulic dredge to increase the main pump efficiency comprises a casing and a vaned impeller located in the casing and mounted for rotation about a normally horizontal axis transverse to the ladder. The casing has an inlet and an outlet defining respective axes lying in a common plane perpendicular to the impeller axis and defining a deflection angle therebetween, with approximately 60° being typical. The diameter of the impeller and the inner dimensions of the casing together define a substantial clearance over at least that portion of an impeller vane's travel between the inlet and the outlet, so that large solid objects entering the pump may pass under the impeller and out the pump outlet. The impeller may have substantially rigid vanes, or the vanes may be flexible. The ladder pump fits in-line with respect to the suction pipe, and has an axial extension little wider than the pipe itself. Thus it is readily positioned proximate the suction mouthpiece where it can work most effectively.

13 Claims, 6 Drawing Figures

IN-LINE CENTRIFUGAL PUMP

FIELD OF THE INVENTION

This invention relates generally to pumps, and more specifically to an in-line centrifugal pump used in conjunction with a standard centrifugal pump in a hydraulic dredging operation.

BACKGROUND OF THE INVENTION

Hydraulic dredging provides an economical way of maintaining adequate depth in navigation channels necessary for commercial shipping. While hydraulic dredges differ in design and size, depending on the particular application intended, a typical hydraulic cutterhead dredge comprises a barge, a downwardly inclined ladder extending from the front of the barge, a rotating cutter at the lower end of the ladder for cutting and agitating material in the channel bottom, a main pump on the barge, and a suction pipe extending from the main pump and down the ladder, the suction pipe having an inlet, called the suction mouthpiece, proximate the cutter so that material stirred up by the cutter is drawn into the pipe by the main pump. The ladder is typically positioned by a ladder suspension system including a vertical H-frame extending upwardly from the front of the barge, an inclined A-frame extending forwardly and upwardly from the bow of the barge, and suitable rigging. A motor at the top of the ladder transmits rotary motion to the cutter by means of a cutter shaft extending down the ladder. Positioning and movement of the dredge is accomplished with paired vertical spuds located at the stern of the dredge along with a winch located on the forward deck. This winch controls wire ropes that pass through sheaves at the lower end of the digging ladder and terminate at anchors on each side of the dredge cut. During operation, the spuds are alternately lowered and the dredge rotated partially about the lowered spud. By alternately pulling on the wire ropes, the dredge is caused to swing back and forth at a slow speed, and so control the width of cut and rate of excavation.

The main pump on the barge produces a suction at the suction mouthpiece proximate the cutter so that material may be drawn upwardly into the pump on the barge. The material exits the pump and is discharged via a pipeline to a location suitably removed from the channel. For example, the material may be discharged onto land or into the water at a distance from the channel. The main pump is typically a standard centrifugal pump with a fluid inlet coaxial with the impeller axis, and a fluid outlet generally tangential with respect to the impeller. By way of illustration, such a pump for a relatively large dredge having a 24 inch diameter discharge pipe might have a 28 inch diameter suction pipe. The main pump impeller will have a minimum clearance between the vanes of approximately 13" by 17" for the passage of the dredged material entering the pump. This clearance is important as described below. The main pump impeller is rotated by an engine or electric motor supplying approximately 5,000 horsepower.

A variety of operating conditions severely compromise the efficiency and capacity of the dredge pump. For example, the dredge pump must accept not only mud, clay, sand, and gravel, but also large stones, pieces of water-logged wood, lengths of wire rope, rubber hose, automobile tires, bottles, tin cans, broken-up concrete, and the whole variety of trash material that finds its way into a navigation channel. This condition compels that there be a substantial clearance between the impeller vanes thus limiting the number of vanes, and also requires that there be a significant clearance between the vane tips and the periphery of the pump casing. This is in contrast to water pumps where the clearance between the vane tips and the pump casing is kept as small as possible at the point of discharge where the water exits from the pump chamber.

When an object enters the pump that is too large to pass through, the dredge must cease operations until the object is removed. In most cases it will be found that the object has jammed against the leading edges of the impeller vanes, and can be removed through a manhole located in the suction pipe immediately in front of the pump. Occasionally the pump will have to be disassembled in order to remove the object.

Another operating condition unique to suction dredging is that when dredging an area having a bottom characterized by gas deposits and the like, gas can become entrained in the fluid entering the inlet mouthpiece. This can cause the main pump to lose its prime, or at least cause it to operate in less than an optimal manner. Also, the phenomenon of cavitation wherein vapor bubbles form and subsequently collapse within the pump degrades performance and subjects the pump to a risk of damage. The avoidance of cavitation often entails running the pump more slowly than would otherwise be desirable or using an impeller with a smaller diameter.

Problems due to loss of prime and cavitation may be reduced if the fluid material being dredged is pumped to the main pump inlet at a positive pressure. It has also been found that the main pump operates more efficiently if the fluid at its inlet is at a positive pressure. Such a positive pressure allows the pump energy to be transferred to the fluid in the form of kinetic energy (velocity head) rather than being transformed into static pressure head. Thus the fluid exits the pump at a greater velocity, whereby discharge transport is facilitated.

One method of supplying this positive pressure at the pump inlet presently in use has been to provide a water-jet pump booster system which injects a high velocity stream of water into the suction pipe aft of the mouthpiece to add energy to the suction system. While not actually adding any energy to the pump itself, the provision of such a booster system does in some conditions allow the pump to operate more efficiently, the increase in efficiency more than offsetting the power required by the booster system. However, it will be immediately appreciated that the water-jet pump booster system has the disadvantage of requiring a greater main pump capacity due to the increased volume of fluid passing into the suction inlet. In cases where the main pump is already operating to capacity, the booster system actually degrades overall performance.

An alternate approach has been to provide a centrifugal pump on the ladder, such a pump being conveniently referred to as a "ladder pump." However, as described above, the construction of existing centrifugal dredge pumps is such that fluid passing therethrough undergoes one or more right angle bends. This introduces frictional losses which undermine the potential benefits. Moreover, the most advantageous location for the ladder pump is as close to the suction mouthpiece as is practical. However, the configuration of the conventional dredge pump with the right angle bends precludes locating the pump proximate the mouthpiece because the inlet pipe or outlet pipe would extend beyond the sides of the digging ladder. The operation of the dredge requires that the digging ladder have as compact configuration as possible consistent with accomodating the cutter, cutter shaft, the suction pipe and the ladder suspension rigging. Extending the width of the digging ladder will interfere with positioning the cutter in close-clearance situations, as for example dredging alongside a dock. While the ladder pump would preferably be located as near the suction mouthpiece as possible, the above-mentioned clearance problems tend to dictate a position generally near the top of the ladder. Even if placement near the suction mouthpiece is feasible, the relatively heavy weight of a conventional centrifugal pump puts a maximum strain on the suspension system. This may make it difficult to retrofit dredges with ladder pumps without costly modification.

Thus, while the aforementioned approaches to the problem of increasing main pump efficiency and capacity have provided benefits by way of increased production, they have been accompanied by offsetting detriments that have rendered their implementation less than ideal. Nevertheless, the disadvantages described above have been accepted as inevitable for those situations where the benefits outweigh the detriments.

SUMMARY OF THE INVENTION

The present invention provides a ladder pump that fits within the lateral confines of existing ladders and is accompanied by the introduction of only small frictional losses in the suction system. The pump of the present invention is easily and quickly removed from the ladder for maintenance purposes.

Broadly, a pump according to the present invention is an in-line centrifugal pump comprising a casing and a vaned impeller located in the casing and mounted for rotation about a normally horizontal axis transverse to the ladder. The casing has an inlet and an outlet defining respective axes lying in a common plane perpendicular to the impeller axis and defining a deflection angle therebetween, with approximately 60° being typical. The impeller is driven so that the vanes are moving toward the barge at their lowest position and away from the barge at their highest position. The inlet and outlet axes are generally tangential with respect to the impeller, the inlet axis being aligned with the suction mouthpiece. Fluid thus enters the pump below the impeller axis in a direction generally parallel to the ladder, and exits the pump in a direction upwardly inclined from the ladder at the aforementioned relatively small angle. The diameter of the impeller and the inner dimensions of the casing together define a substantial clearance over at least that portion of an impeller vane's travel between the inlet and the outlet, so that large solid objects entering the pump may pass under the impeller and out the pump outlet. This clearance is preferably larger than the smallest clearances in the main pump.

The impeller may have substantially rigid vanes, in which case the pump has a cutwater clearance which extends over that portion of the impeller's travel from the outlet to the inlet. Such a clearance is typically smallest near the pump outlet and gradually expands toward the pump inlet. The smallest clearance preferably corresponds to the smallest clearance in the main pump located on the barge.

In an alternate embodiment, the vanes may be flexible, in which case the minimum cutwater clearance may be reduced or eliminated. For the rigid vane embodiment, the impeller may be closed, that is, having shrouds at each axial end of the vanes. Such shrouds have the effect of providing structural support to the vanes and possibly increasing pumping efficiency. An alternate embodiment of a rigid vaned impeller has a single shroud at one axial end. This permits the impeller to be manufactured in a single cavity mold in the event that it is desired to fabricate the impeller from a resilient material such as rubber.

The ladder pump has a simple and compact configuration. In particular, it fits in-line with respect to the suction pipe, and has an axial extension little wider than the pipe itself. Thus it is readily positioned proximate the suction mouthpiece where it can work most effectively. Moreover, the simple and compact configuration of the ladder pump is accompanied by a correspondingly lower cost, thus making it economically practical to carry a spare ladder pump on the barge. Additionally, the compactness and light weight make it a relatively easy matter to retrofit existing ladders with such a pump without major modification.

According to a further aspect of the present invention, the pump is held in position by flanges that define respective planes at a small angle with respect to each other, the flanges being slightly convergent at their lower ends, thus allowing the pump to be quickly lifted from its position in the suction line should it become necessary to remove the pump for repair, replacement, or the like.

For a further understanding of the nature and advantages of the present invention, reference should be had to the remaining portions of this specification and to the attached drawings.

DETAILED DESCRIPTION OF THE INVENTION

Figure 1:
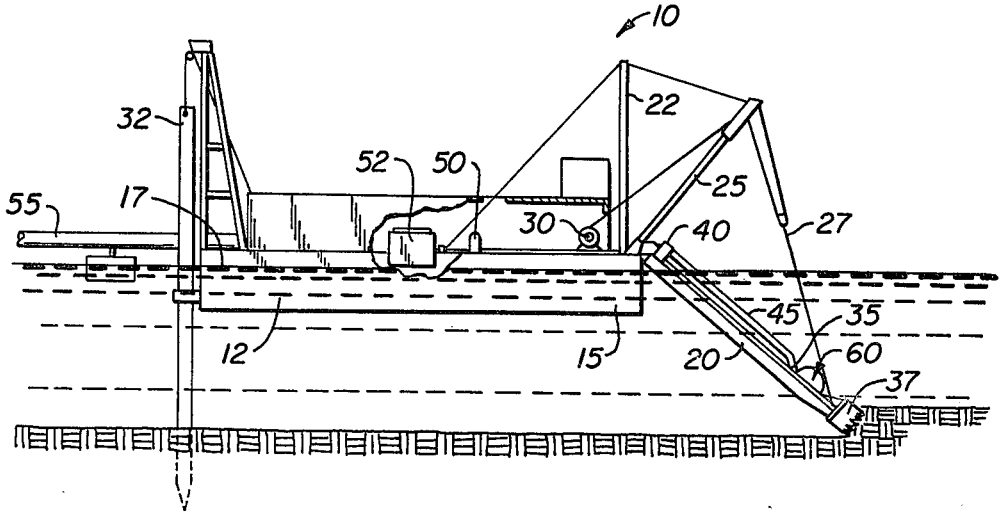
FIG. 1 is a schematic elevational view of a typical hydraulic cutterhead dredge showing the positioning of the pump according to the present invention in relation to the other components.

FIG. 1 is a schematic elevational view, partly cut away, showing the main components of a standard cutterhead hydraulic dredge 10. Dredge 10 includes a floating barge 12 having a bow 15 and a stern 17. A downwardly sloped ladder 20 is pivotally connected to barge 10 at bow 15 for rotation about a transverse axis. A vertical H-frame 22 and a forwardly extending upwardly inclined A-frame 25 cooperate with suitable rigging 27 and a winch 30 on the barge to raise and lower ladder 20 so that its slope angle may be changed to suit the depth of the channel being dredged. Positioning and movement of dredge 10 is accomplished with paired vertical spuds, one spud 32 which is shown, located at stern 17. The spuds are alternately lowered and the dredge rotated thereabout by means of swing cables which are attached to swing anchors, not shown.

Figure 2:
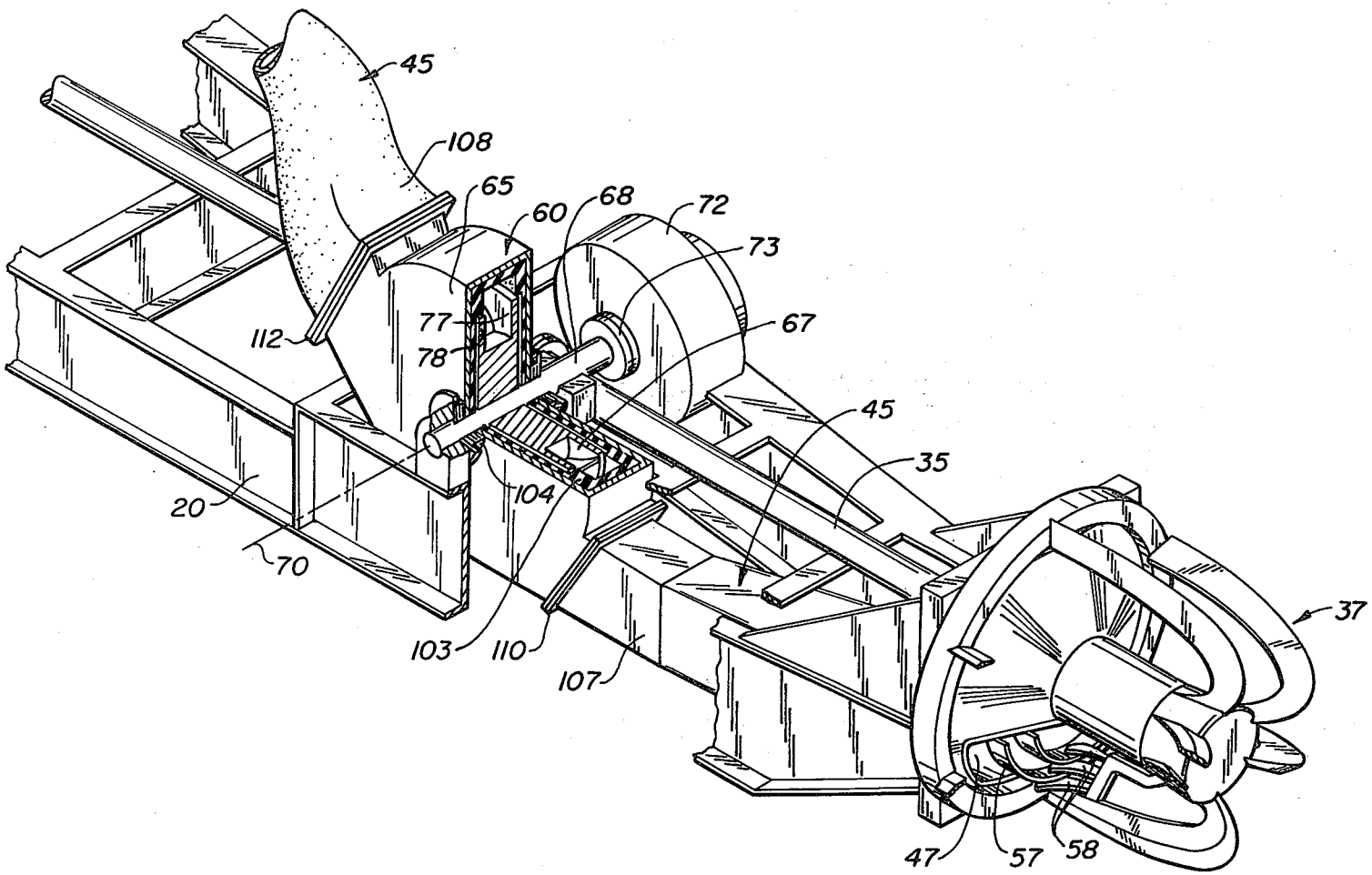
FIG. 2 is a perspective view showing the disposition of the pump in the suction line proximate a forward end of the ladder.

With respect to components mounted on ladder 20, additional reference should be had to FIG. 2. A cutter shaft 35 extends along ladder 20 and carries a cutter 37 at a forward end thereof, cutter 37 being disposed immediately ahead of the forward (lower) end of ladder 20. A cutter motor 40 is mounted to ladder 20 proximate its upper end for transmitting rotational motion to cutter 37 via cutter shaft 35. A suction pipe 45 has an open end at a suction mouthpiece 47 located immediately behind cutter 37, and extends upwardly therefrom along ladder 20. Suction pipe 45 includes a section on ladder 20 and a horizontal section on barge 12, with a suitable flexible coupling therebetween. Suction pipe 45 communicates to the inlet of a main pump 50 on barge 12. Main pump 50 is powered by a main pump engine 52, which may be a diesel engine, an electrical motor, or a turbine. Pump 50 is a centrifugal pump having an impeller rotatably mounted within a housing with the pump inlet coaxial with the impeller axis of rotation and the outlet perpendicular thereto and displaced radially therefrom. In operation, cutter 37 is rotated by cutter motor 40 in order to agitate and cut material on the bottom of the channel, which material is sucked into suction mouthpiece 47, and through suction pipe 45 by main pump 50. Main pump 50 discharges the cut material and water via a pipeline 55 to a location suitably removed from the channel being dredged. The general principles of hydraulic dredging operations as summarized above are set forth in considerable detail in "Hydraulic Dredging" by John Huston (Cornell Maritime Press, Inc., 1970) and "Coastal and Deep Ocean Dredging" by John B. Herbich (Gulf Publishing Company, 1975).

The present invention provides a ladder pump 60 disposed in line with suction pipe 45 at a position as close as convenient to suction mouthpiece 47. In order to cut down on possible clogging of ladder pump 60, suction mouthpiece 47 is preferably fitted with a strainer mechanism comprising curved strainer bars 57 rigidly mounted coaxially with cutter shaft 35. Cutter 37 carries a cooperating plurality of wiper blades 58 adapted to sweep between strainer bars 58 as cutter 37 rotates. Two such strainer bars and three such wiper blades are suitable. Thus oversized material is kept out of suction pipe 45 by strainer bars 57, and the material is prevented from blocking suction mouthpiece 47 by the action of wiper blades 58.

Figure 3:
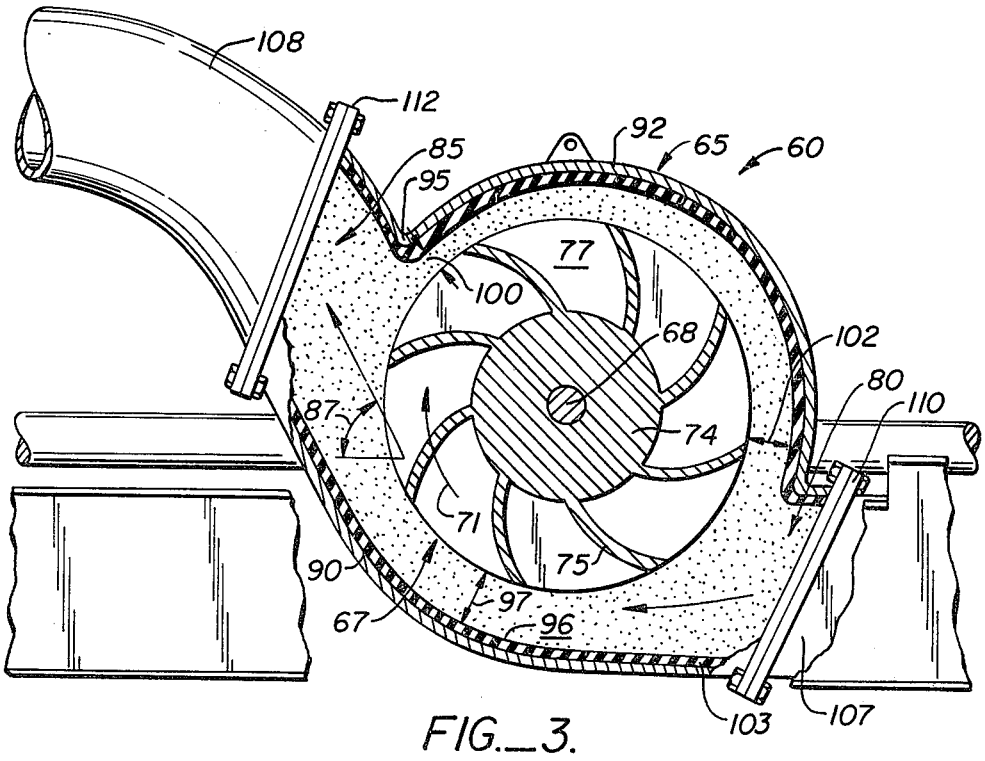
FIG. 3 is a side elevational view, partly cut-away, showing the pump of the present invention.

The particular construction of ladder pump 60 is best seen with reference to FIGS. 2 and 3. Broadly, ladder pump 60 comprises a housing 65 and an impeller 67 mounted within housing 65 on a shaft 68 for rotation about a normally horizontal axis 70 transverse to the direction of extension of ladder 20. The sense of rotation is indicated by arrow 71, and is established by an electric motor or hydraulic motor 72 coupled to shaft 68 by a flange coupling 73. Although several embodiments of impeller 67 will be described below, for the purpose of understanding the basic pump operation, a particular embodiment is shown in FIGS. 2 and 3. Impeller 67 includes a central hub 74 and a plurality of curved backswept vanes 75 extending outwardly therefrom. While conventional centrifugal pumps have impellers with three to five vanes, impeller 67 has approximately eight vanes. Vanes 75 are axially bounded by paired shrouds 77 and 78, which shrouds are circular and coaxial with shaft 69.

Housing 65 defines an inlet 80 and an outlet 85, each defining a respective direction perpendicular to impeller shaft 68 and generally displaced therefrom. Fluid flowing through casing 65 from inlet 80 to outlet 85 passes underneath impeller 67 along a path generally following the rotation of impeller 67. The direction of flow at outlet 85 is typically deflected with respect to the direction of flow at inlet 80, thus defining a deflection angle 87. Deflection angle 87 represents a compromise. On one hand, a certain amount of impingement is necessary in order that the impeller vanes do the necessary work in pumping fluid. On the other hand, a large deflection angle increases frictional losses within ladder pump 60 and necessitates other sharp bends in the ladder discharge pipe 45, thereby reducing the compactness of the configuration and introducing further frictional losses. An angle of approximately 60° has been found suitable, but, depending on materials and conditions, other deflection angles less than approximately 90° may be suitable. In some cases, the inlet and outlet may be parallel.

For convenience, housing 65 may be considered to have a lower housing portion 90 extending from inlet 80 to outlet 85 below impeller 67 and an upper housing portion 92 extending from inlet 80 to outlet 85 generally above impeller 67. Lower housing portion 90 provides a smooth transition between inlet 80 and outlet 85, while upper housing portion 92 joins to the inlet and outlet at substantial angles, providing a cutwater 95 where it meets outlet 85.

Lower housing portion 90 has an inner surface 96 that is preferably spaced radially outward from the radially outermost portion of impeller 67 to define a clearance dimension 97. The purpose of clearance dimension 97 is the accomodation without clogging of relatively large solid objects that are drawn into suction mouthpiece 47. Upper housing portion 92 similarly defines a clearance with respect to impeller 67, but this clearance is generally smaller than clearance dimension 97 since relatively large solid objects are expected to be discharged through outlet 85 and not circulate entirely around within the pump. This upper clearance may have a first dimension 100 at cutwater 95, expanding to a second larger dimension 102 proximate inlet 80, the change in dimension being gradual, preferably following a volute curve.

Figure 4A:
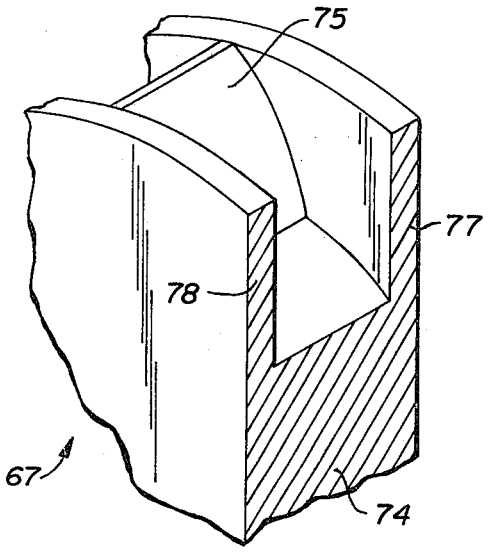
FIGS. 4A, 4B, and 4C are fragmentary perspective views showing alternate embodiments of the impeller.
Figure 4B:
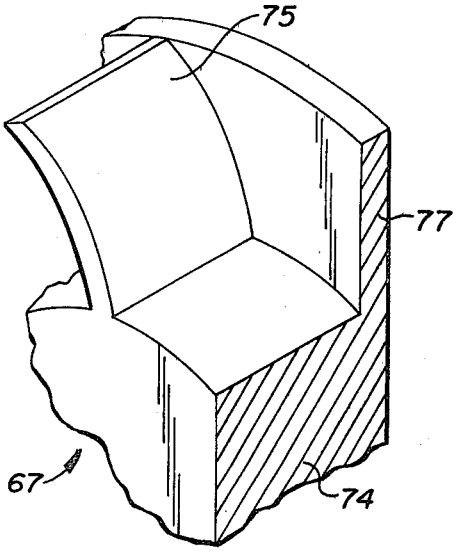
Figure 4C:
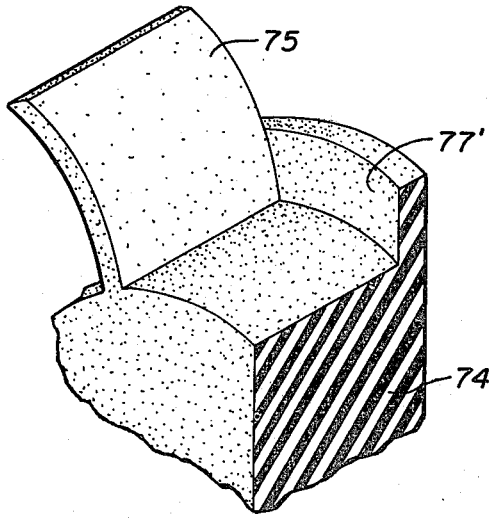

FIGS. 4A, 4B, and 4C are fragmentary perspective views of alternate embodiments of impeller 67 with like reference numerals designating corresponding elements. For reference purposes, FIG. 4A shows a closed impeller as illustrated in FIG. 2. In particular, shrouds 77 and 78 provide structural support for vanes 75 and thus impart rigidity to impeller 67. FIG. 4B illustrates an impeller similar to that shown in FIG. 4A, except that shroud 77 is the only shroud. This configuration is advantageous in the event that it is desired to fabricate impeller 67 from a resilient material by a molding process. In particular, it will be appreciated that a single shrouded impeller as shown may be manufactured in a single cavity mold.

While the impeller embodiments of FIG. 4A and 4B have been characterized by one or two shrouds extending the entire radial dimension of the impeller, FIG. 4C shows an embodiment wherein vanes 75 extend radially beyond the shroud dimension. This embodiment is advantageous for an impeller made in whole or in part of a resilient material where it is desired to have flexible vanes. FIG. 4C shows an impeller having a single shroud 77' that has a radial extent less than that of vanes 75. Thus, vanes 75 are provided with a certain amount of structural reinforcement where they join to hub 74, but are free to flex at their outer ends. As discussed above, the single shroud embodiment is especially well adapted to fabricating the impeller from a material such as rubber. In the event that impeller 67 is provided with flexible vanes, either as permitted by one or more shrouds of lesser radial dimension or by the elimination of shrouds entirely, cutwater clearance dimension 100 may be substantially reduced, even being reduced to zero so that the vanes impinge on the inner surface of upper housing portion 92.

Pump casing 65 is of standard metal construction suitable for a pump of a given size, and is preferably fitted with a wear liner 103 as described in my U.S. Pat. No. 4,120,605, issued Oct. 17, 1978, entitled "Wear Liners For Abrasive-Material Handling Equipment". Wear liner 105 according to the above referenced U.S. Patent, is of composite construction and includes a layer of vulcanized rubber or equivalent material with one or more sheets of abrasive resistant wire mesh embedded therein. Casing 65 is preferably provided with stuffing boxes 104 at the locations where impeller shaft 68 penetrates the casing.

While the size and dimensions of ladder pump 60 are dependent upon the size of the dredge and the main pump in conjunction with which the ladder pump is used, some representative dimensions will be set forth below for the purpose of illustration only in order to put the various clearances in a better perspective. In particular, the dimensions set forth below are reasonable for a pump having an inlet and outlet defined by a first transverse dimension parallel to impeller axis 70 of 32 inches and a second transverse dimension perpendicular to impeller axis 70 of 22 inches. From a flow point of view, this corresponds approximately to a circular pipe having an inner diameter of 30 inches. In such a situation, impeller 67 has a diameter of 6 feet, with hub 72 having a diameter of 3 feet. Lower clearance dimension 97 is approximately 11 inches, cutwater clearance dimension 100 is approximately 5 inches, and clearance dimension 102 is approximately 9 inches. A pump having these general dimensions would be suitable for use in a barge having a main pump driven by a 8,000 horsepower engine, and ladder pump motor 72 would be required to have an output of approximately 800 horsepower. A radial clearance of approximately 7 inches between adjacent strainer bars 57 would be appropriate for a configuration having the above dimensions.

With specific reference to FIG. 2, it can be seen that pump 60 is located to one side of cutter shaft 35 and ladder pump motor 72 is located on the other side. This configuration is convenient and is made possible by the fact that pump 60 has a relatively narrow axial dimension (approximately 3 feet) that is not significantly wider than the transverse extent of suction pipe 45. The relatively short portion of suction pipe 45 located between centrally located suction mouthpiece 47 and off-center ladder pump 60 is angled with respect to the direction of cutter shaft 35 in order to achieve the needed transverse displacement. Pump 60 is fastened to respective inlet and outlet segments 107 and 108 of suction pipe 45 by means of first and second mating flange pairs 110 and 112. In order to facilitate removal and replacement of pump 60 within the suction line, flange pairs 110 and 112 are preferably not parallel, but rather converge slightly in the downward direction. An inclination of about 5° is suitable. The tapered configuration provides an increasing clearance as pump 60 is removed from the line, and a guiding and self-positioning function when pump 60 is placed in position.

Having set forth the structure of ladder pump 60 and the environment in which it operates, the operation may be understood. In particular, ladder pump motor 72 causes impeller 67 to rotate at approximately 600–900 revolutions per minute, with the result that a suction is provided at suction mouthpiece 47 for drawing water and entrained solid material through inlet 80 into the interior of pump 60. The energy supplied to pump 60 provides the incoming fluid with kinetic energy and discharges it through pump outlet 85 with sufficient head to enter the inlet of main pump 50 at a positive pressure. As discussed in the introductory portions of this patent application, a positive pressure at the inlet of the main pump allows the main pump to operate at a considerably higher efficiency and capacity, thereby allowing a greater output from the dredge. It should be noted that the design of ladder pump 60, dictated by a desire to avoid sharp bends in the fluid flow path and a desire to provide relatively large clearances for trash and debris, results in a pump having a relatively low efficiency. However, the increase in main pump efficiency far exceeds any inefficiencies and losses within ladder pump 60.

In summary, it can be seen that the present invention provides a ladder pump having a surprisingly compact and simple configuration, thus allowing the pump to be situated on the ladder in a position very close to the suction mouthpiece without interfering with other components mounted on the ladder. While the above description provides a full and complete disclosure of the preferred embodiments of the invention, various modifications, alternate constructions, and equivalents may be employed without departing from the true spirit and scope of the invention. For example, the orientation and location of the pump on the ladder could be changed in order to accomodate different ladder configurations. Therefore, the above description and illustration should not be construed as limiting the scope of the invention which is defined by the appended claims.

What is claimed is:

1. An in-line centrifugal pump comprising:

a housing;

an impeller mounted within said housing for preferred sense rotation about an axis;

means on said housing defining an inlet for fluid flow along a first direction perpendicular to said axis; and means on said housing defining an outlet for fluid flow along a second direction perpendicular to said axis;

wherein said first and second directions define a deflection angle therebetween of less than approximately 90%, said preferred sense of rotation of said impeller being such that fluid flowing from said inlet to said outlet along the direction of rotation of said impeller covers an arc subtending said deflection angle, and wherein said impeller has a predetermined outer diameter and said housing has inner dimensions related to said diameter to define a substantial first clearance between said housing and said impeller over a portion of said impeller's travel extending from said inlet to said outlet along the direction of rotation of said impeller.

2. The invention of claim 1 wherein said impeller outer diameter and said housing inner dimensions also define a second clearance over a portion of said impeller's travel extending from said outlet to said inlet along the direction of rotation of said impeller.

3. The invention of claim 2 wherein said second clearance is characterized by a first dimension proximate said outlet and a second dimension proximate said inlet, said second dimension being larger than said first dimension.

4. The invention of claim 1 wherein said impeller comprises a central hub portion of a diameter less than said impeller outer diameter, a plurality of curved vanes extending outwardly from said hub to a position defining said impeller outer diameter, and a circular shroud coaxial with said hub portion.

5. The invention of claim 4 wherein said shroud has a diameter equal to said impeller outer diameter.

6. The invention of claim 4 wherein said shroud is the only shroud on said impeller.

7. The invention of claim 1 wherein said impeller is at least in part fabricated from a resilient material.

8. Apparatus for use on a hydraulic dredge for providing positive pressure at the inlet of a main dredge pump on a barge comprising:

a ladder extending downwardly from the bow of said barge;

a suction pipe extending from said main pump and downwardly along said ladder, said suction pipe having a mouthpiece proximate a lower end of said ladder;

a housing disposed in line with said suction pipe at a position proximate said mouthpiece and having means defining an inlet and outlet, said inlet and outlet defining first and second directions being displaced by an angle relative to one another of less than approximately 90°; and an impeller having a predetermined outer diameter mounted within said housing for preferred sense rotation about an axis perpendicular to said first and second directions, said preferred sense of rotation being such that fluid flowing from said inlet to said outlet along the direction of rotation of said impeller covers an arc subtending said angle of less than approximately 90°.

9. The invention of claim 8 wherein said impeller has a predetermined outer diameter and said housing has inner dimensions defining a substantial first clearance between said housing and said impeller outer diameter over a portion of said impeller's travel extending from said inlet to said outlet along the direction of rotation of said impeller.

10. In a dredge including a barge, a ladder extending downwardly from the bow of said barge, a cutter at a leading end of said ladder, a main pump on said barge, a suction pipe extending from said main pump and downwardly along said ladder, said suction pipe having a suction mouthpiece proximate said cutter head, an improved ladder pump situated on said ladder mounted in-line within said suction pipe and at a position proximate said suction mouthpiece, said ladder pump comprising:

a housing;

an impeller of predetermined outer diameter mounted within said housing for preferred sense rotation about a normally horizontal axis transverse to said ladder;

means on said housing defining an inlet for fluid flow along a first direction perpendicular to said axis; and means on said housing defining an outlet for fluid flow along a second direction perpendicular to said axis, said second direction defining a deflection angle relative to said first direction of less than approximately 90°, said preferred sense of rotation of said impeller being such that fluid flowing from said inlet to said outlet along the direction of rotation of said impeller covers an arc subtending said deflection angle;

wherein said housing has inner dimensions defining a substantial radial clearance around said impeller over a portion of said impeller's travel extending from said inlet to said outlet along the direction of rotation of said impeller.

11. The invention of claim 10 wherein said suction pipe has a transverse dimension parallel to said axis that is narrower than said ladder and wherein said housing has a dimension transverse to said ladder and parallel to said axis that is narrower than the transverse dimension of said ladder parallel to said axis.

12. The invention of claim 10 also comprising first and second flanges on said housing adapted to mate with correspondingly configured first and second flanges on said pipe to provide continuous flow path through said pump, said first and second flanges on said pump defining respective planes that slope downwardly towards each other to facilitate removal and insertion of said pump between said correspondingly configured first and second flanges on said suction pipe.

13. In a method of dredging solid material located at a first lower level including the steps of cutting and agitating said solid material, entraining said cut material in a liquid stream to form a slurry, flowing said slurry along a flow path upwardly to a main pump at a second upper level, the improvement comprising the steps of:

submerging a vaned impeller in said slurry over a region of said flow path proximate said lower level;

rotating said impeller about an axis perpendicular to the direction of the flow path in said region so that said vanes move in the direction of said flow path over an arc; of their rotation subtending an angle of less than approximately 90°, thereby adding kinetic energy to said slurry over said region of the flow path, while maintaining the proportion of solids to liquid in the slurry substantially constant and while avoiding sharp bends in the flow path, such that said slurry enters said main pump at a positive pressure to increase the efficiency of said main pump.

* * * * *

UNITED STATES PATENT AND TRADEMARK OFFICE

CERTIFICATE OF CORRECTION

PATENT NO. : 4,305,214

DATED : December 15, 1981

INVENTOR(S) : George P. Hurst

It is certified that error appears in the above-identified patent and that said Letters Patent are hereby corrected as shown below:

Column 10, Claim 13, line 49 should read as follows:

-- over an arc of their rotation subtending an angle of --.

Signed and Sealed this

Sixteenth Day of March 1982

[SEAL]

Attest:

GERALD J. MOSSINGHOFF

Attesting Officer

Commissioner of Patents and Trademarks